US006247430B1

(12) United States Patent
Yapici

(10) Patent No.: US 6,247,430 B1
(45) Date of Patent: Jun. 19, 2001

(54) COMPRESSION RATIO SETTING DEVICE FOR AN INTERNAL-COMBUSTION ENGINE

(75) Inventor: Kurt Imren Yapici, Aachen (DE)

(73) Assignee: FEV Motorentechnik GmbH & Co. Kommandgesellschaft, Aachen (DE)

( * ) Notice: Subject to any disclaimer, the term of this patent is extended or adjusted under 35 U.S.C. 154(b) by 0 days.

(21) Appl. No.: 09/182,425

(22) Filed: Oct. 30, 1998

(30) Foreign Application Priority Data

| | | |
|---|---|---|
| Oct. 31, 1997 | (DE) | 297 19 343 U |
| Mar. 26, 1998 | (DE) | 198 13 386 |
| Sep. 10, 1998 | (DE) | 198 41 381 |

(51) Int. Cl.[7] ..... F02B 75/04
(52) U.S. Cl. ..... 123/78 F; 123/48 B
(58) Field of Search ..... 123/48 B, 78 BA, 123/78 F, 78 R

(56) References Cited

U.S. PATENT DOCUMENTS

| | | | | |
|---|---|---|---|---|
| 936,409 | * | 10/1909 | Chapman | 123/48 B |
| 1,553,009 | * | 9/1925 | Stuke | 123/78 F |
| 1,875,838 | * | 9/1932 | Winckler | 123/48 B |
| 2,241,378 | * | 5/1941 | Evans | 123/48 B |
| 3,686,972 | * | 8/1972 | McWhorter | 74/602 |
| 4,437,438 | | 3/1984 | Mederer . | |
| 4,738,230 | * | 4/1988 | Johnson | 123/48 B |
| 4,860,702 | * | 8/1989 | Doundoulakis | 123/78 F |
| 4,957,069 | | 9/1990 | Mederer . | |
| 4,969,430 | * | 11/1990 | Masuda | 123/196 R |
| 5,908,012 | * | 6/1999 | Endoh | 123/48 B |

FOREIGN PATENT DOCUMENTS

| | | | | |
|---|---|---|---|---|
| 29 35 073 | | 3/1981 | (DE) . | |
| 29 35 977 | | 3/1981 | (DE) . | |
| 30 04 402 | | 8/1981 | (DE) . | |
| 30 30 615 | | 9/1983 | (DE) . | |
| 36 01 528 | | 7/1987 | (DE) . | |
| 36 44 721 | | 7/1988 | (DE) . | |
| 37 15 391 | | 12/1988 | (DE) . | |
| 20326 | * | of 1906 | (GB) | 123/48 B |
| 55-64131 | * | 5/1980 | (JP) | 123/78 F |

* cited by examiner

*Primary Examiner*—Noah Kamen
(74) *Attorney, Agent, or Firm*—Venable; Gabor J. Kelemen

(57) ABSTRACT

An internal-combustion engine includes a cylinder block; a plurality of cylinders arranged in line in the cylinder block; a piston accommodated for reciprocating motion in the respective cylinders; a crankshaft received in the cylinder block; a connecting rod coupling each piston with the crankshaft; and a plurality of eccentric rings surrounding and supporting the crankshaft. Each eccentric ring is rotatable about a common ring axis radially spaced from the crankshaft axis. Further, ring-supporting bearing housings are accommodated in the cylinder block for supporting the eccentric rings. A ring-turning assembly adjusts in unison the angular position of the eccentric rings to radially shift the crankshaft, whereby the upper dead center position of the pistons is altered for varying the compression ratio thereof. The ring-turning assembly includes a setting drive for exerting a force upon actuation thereof; ring-turning components connected to at least some of the eccentric rings; and a coupling element connecting the setting drive with the ring-turning components for transmitting the force exerted by the setting drive to the ring-turning components for rotating the eccentric rings.

9 Claims, 11 Drawing Sheets

$6_4$
$6_3$
$6_2$
$6_1$
5
1
3
2
7
A
9
10
11
8
12
13
14
16
4
II

COMPRESSION RATIO SETTING DEVICE FOR AN INTERNAL-COMBUSTION ENGINE

CROSS REFERENCE TO RELATED APPLICATION

This application claims the priority of German Application Nos. 297 19 343.0 filed Oct. 31, 1997, 198 13 386.3 filed Mar. 26, 1998 and 198 41 381.5 filed Sep. 10, 1998, which are incorporated herein by reference.

BACKGROUND OF THE INVENTION

In normal reciprocating piston-type machines the position of the pistons in the respective engine cylinders depends exclusively from the angular position of the crankshaft. According to a conventional arrangement for changing the compression ratio as a function of operational conditions, the connecting rod of each piston is subdivided into two connecting rod parts which are coupled with one another by a central joint. Further, a control arm is articulated at one end to the connecting rod and is secured, at its other end, to a pivotal support slidable on the machine housing.

The above-outlined constructions are described, for example, in German Offenlegungsschriften (applications published without examination) 29 35 073, 29 35 977, 30 30 615 (to which corresponds U.S. Pat. No. 4,437,438) and 37 15 391 (to which corresponds U.S. Pat. No. 4,957,069). In the structures described therein the control arm is directly coupled to the central joint, giving rise to substantial structural and operational problems. The central joint has a substantial width and thus has a large weight which, at the given spatial availabilities, cannot be compensated for by counterweights mounted on the crankshaft. On the whole, it is a disadvantage of the prior art structures that the moved masses, that is, the piston and the connecting rod, are increased and therefore greater mass forces have to be overcome.

To avoid the above-noted disadvantages, it is known to change the compression ratio by supporting the crankshaft in eccentric rings which are angularly displaceably (rotatably) supported in the cylinder block and are connected with a setting drive. By rotating the eccentric rings, the position of the crankshaft is shifted such that in the upper dead center position the pistons have a greater or lesser distance from the cylinder roof. For this purpose, German Offenlegungsschrift 30 04 402 provides that each eccentric ring is coupled with a toothed gear meshing with a pinion mounted on a setting shaft which extends parallel to the crankshaft and which is coupled with a setting drive. Apart from a substantial structural and technological input, increased space is needed for accommodating the eccentric rings and the gears disposed in their vicinity.

Further, German Offenlegungsschrift 36 01 528 describes an arrangement wherein the eccentric rings which support the crankshaft bearings are connected with a partial cylinder shell arranged concentrically to the eccentric rings and extending over the entire length of the cylinder block. The partial cylinder shell is provided on its exterior with a toothed segment which meshes with a setting worm extending transversely to the crankshaft and connected with a setting drive. Despite a favorable structural length of the crankshaft support, such a system has the disadvantage that a very compact structural component for the synchronous shifting of the eccentric rings is provided, and that because of the eccentricity of the crankshaft axis relative to the support axis of the eccentric rings, torques appearing during operation may be taken up only through the setting worm.

Since in such a construction only a few teeth are in a meshing relationship with a small degree of overlap, the stress on the component materials is substantial because of the fluctuating loads generated during operation. Even a small play between the toothed segment and the setting worm may lead to a rapidly progressing wear.

Further, German Offenlegungsschrift 36 44 721 describes a system in which each eccentric ring is connected with a laterally projecting lever carrying a bearing block on its free end. Laterally of and parallel to the crankshaft a setting shaft is supported which has a setting drive and which is provided with a fork-like jaw straddling the bearing block of an eccentric ring. Since the bearing blocks cannot be guided in a play-free manner, such a system too, is disadvantageous because the fluctuating torques exerted on the eccentric rings during operation lead in this region to a significant stress on the system which is coupled with an increasing wear in the zone of the bearing block guidance.

SUMMARY OF THE INVENTION

It is an object of the invention to provide an improved internal-combustion engine of the above-outlined type from which the discussed disadvantages are eliminated.

This object and others to become apparent as the specification progresses, are accomplished by the invention, according to which, briefly stated, the internal-combustion engine includes a cylinder block; a plurality of cylinders arranged in line in the cylinder block; a piston accommodated for reciprocating motion in the respective cylinders; a crankshaft received in the cylinder block; a connecting rod coupling each piston with the crankshaft; and a plurality of eccentric rings surrounding and supporting the crankshaft. Each eccentric ring is rotatable about a common ring axis radially spaced from the crankshaft axis. Further, ring-supporting bearing housings are accommodated in the cylinder block for supporting the eccentric rings. A ring-turning assembly adjusts in unison the angular position of the eccentric rings to radially shift the crankshaft, whereby the upper dead center position of the pistons is altered for varying the compression ratio thereof. The ring-turning assembly includes a setting drive for exerting a force upon actuation thereof; a ring-turning component connected to at least some of the eccentric rings; and a coupling element connecting the setting drive with the ring-turning components for transmitting the force exerted by the setting drive to the ring-turning components for rotating the eccentric rings.

The invention provides that in an internal-combustion engine in which the compression ratio may be altered, the support for the setting arrangement does not require an extension of the crankshaft support in the cylinder block so that the usual structural lengths for such cylinder blocks need not be increased. The ring-turning components, the bearing housings and the eccentric rings are expediently dimensioned in such a manner that an axial support for the eccentric rings is obtained. By virtue of the fact that all ring-turning components are connected to one another by means of a coupling element, a synchronous rotation of the eccentric rings is ensured.

According to an advantageous feature of the invention, that portion of an eccentric ring which is oriented towards the associated cylinder has, on its exterior, a circumferentially extending groove which is provided with a radially inwardly oriented bore and further, in the cylinder block a central oil channel is arranged from which branch channels extend which terminate with their open end at the ring-supporting bearing housing in the region of the groove provided in the eccentric ring. This arrangement ensures that the bearing surfaces of the eccentric rings as well as the crankshaft bearings arranged in the eccentric rings are supplied with lubricant.

In accordance with a further advantageous feature of the invention, at least some of the ring-supporting bearing housings are provided with a respective window through which the turning component for the associated eccentric ring passes. In this manner, a compact structure for the entire arrangement and for the turning component is obtained. The coupling element which connects the turning components with one another and with the setting drive may be, according to a further feature of the invention, formed by a setting shaft connected with the setting device and provided with pinions which mesh with the corresponding toothed elements of the respective turning components. According to a further advantageous feature of the invention, the turning components may be pivotal levers which preferably extend downwardly into the oil pan.

In accordance with a further advantageous feature of the invention, the turning components are formed by toothed elements carried by the eccentric rings and coupled with respective toothed transmission elements extending through windows in the ring-supporting bearing housings and mesh with pinions carried by the setting shaft. Such an arrangement allows a relocation of the turning components and the setting shaft in the cylinder block and thus the structural volume of the engine may be maintained small.

DESCRIPTION OF THE PREFERRED EMBODIMENTS

Figure 1:
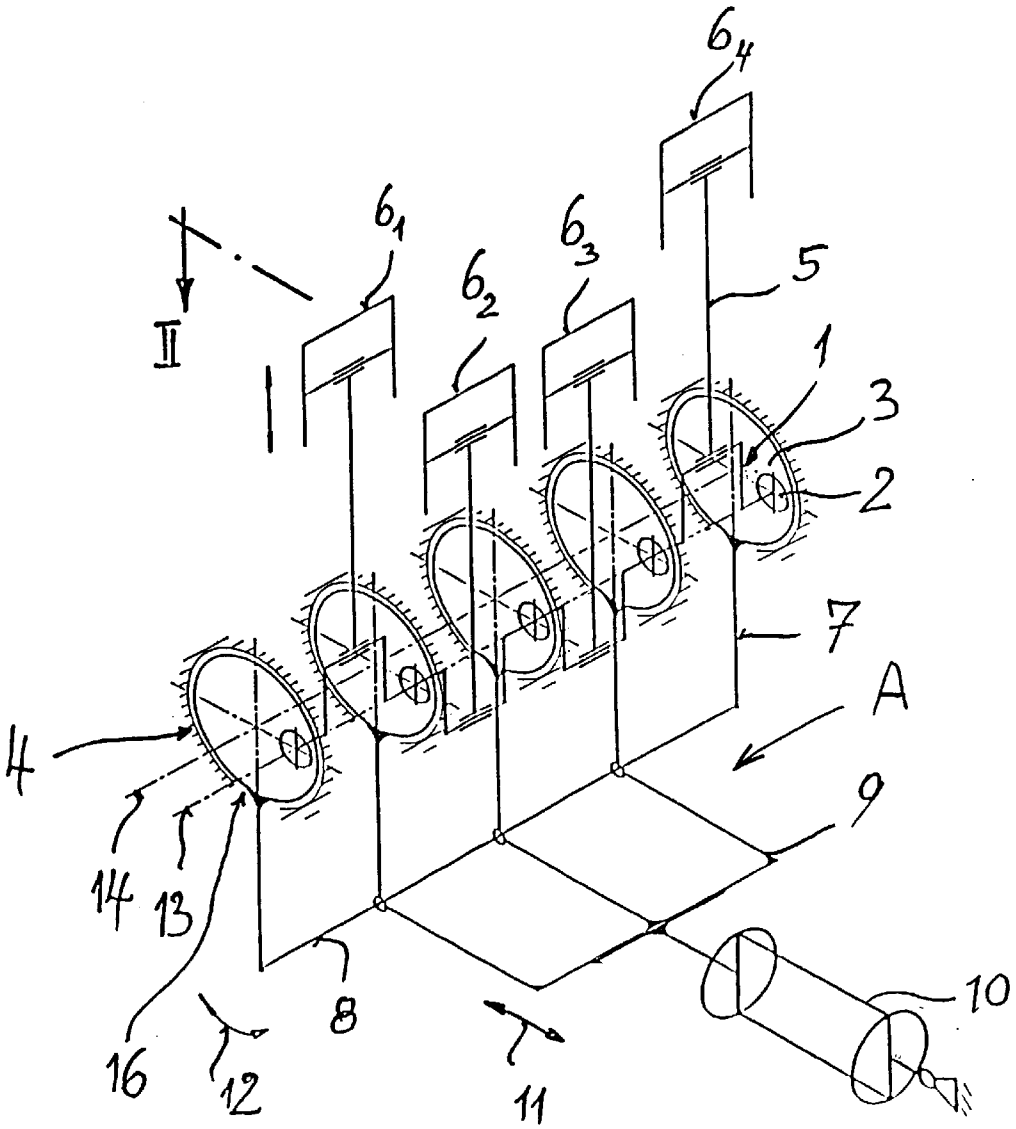
FIG. 1 is a schematic perspective view of a preferred embodiment of the invention installed in a four-cylinder in-line engine.

Turning to FIG. 1, an engine crankshaft 1 is supported in axially spaced crankshaft bearings 2 which, in turn, are supported in rotatable eccentric rings 3. The eccentric rings 3 are rotatably supported in respective ring-supporting bearing housings 4 installed in a cylinder block. Engine pistons 6 are coupled with the crankshaft 1 by respective connecting rods 5. The crankshaft 1 is shown in an angular position in which the pistons 6, and 64 are situated in their upper dead center position, whereas pistons 62 and 63 are situated in their lower dead center position.

Each eccentric ring 3 is rigidly coupled with a respective ring-turning component 7 constituted by a pivot lever which extends from the respective ring-supporting bearing housing 4 in a downward direction through a window 16 provided therein, as will be described later in further detail. The pivot levers 7 are fixedly connected to one another by means of a rod-shaped coupling element 8 so that a synchronous rotation of all the eccentric rings 3 is ensured. The rod 8 is connected with a schematically illustrated setting device 10 by means of a push-pull component 9.

The ring-turning components (pivot levers) 7, the coupling element 8, the push-pull component 9 and the setting device 10 together form a ring-turning assembly A.

Upon motion of the push-pull component 9 in the direction of the double-headed arrow 11, the pivot levers 7 are pivoted back and forth in the direction of the arrow 11, causing a unison rotation of the eccentric rings 3, whereby the height level of the pistons 6 in their upper and lower dead center positions is also changed.

Figure 2:
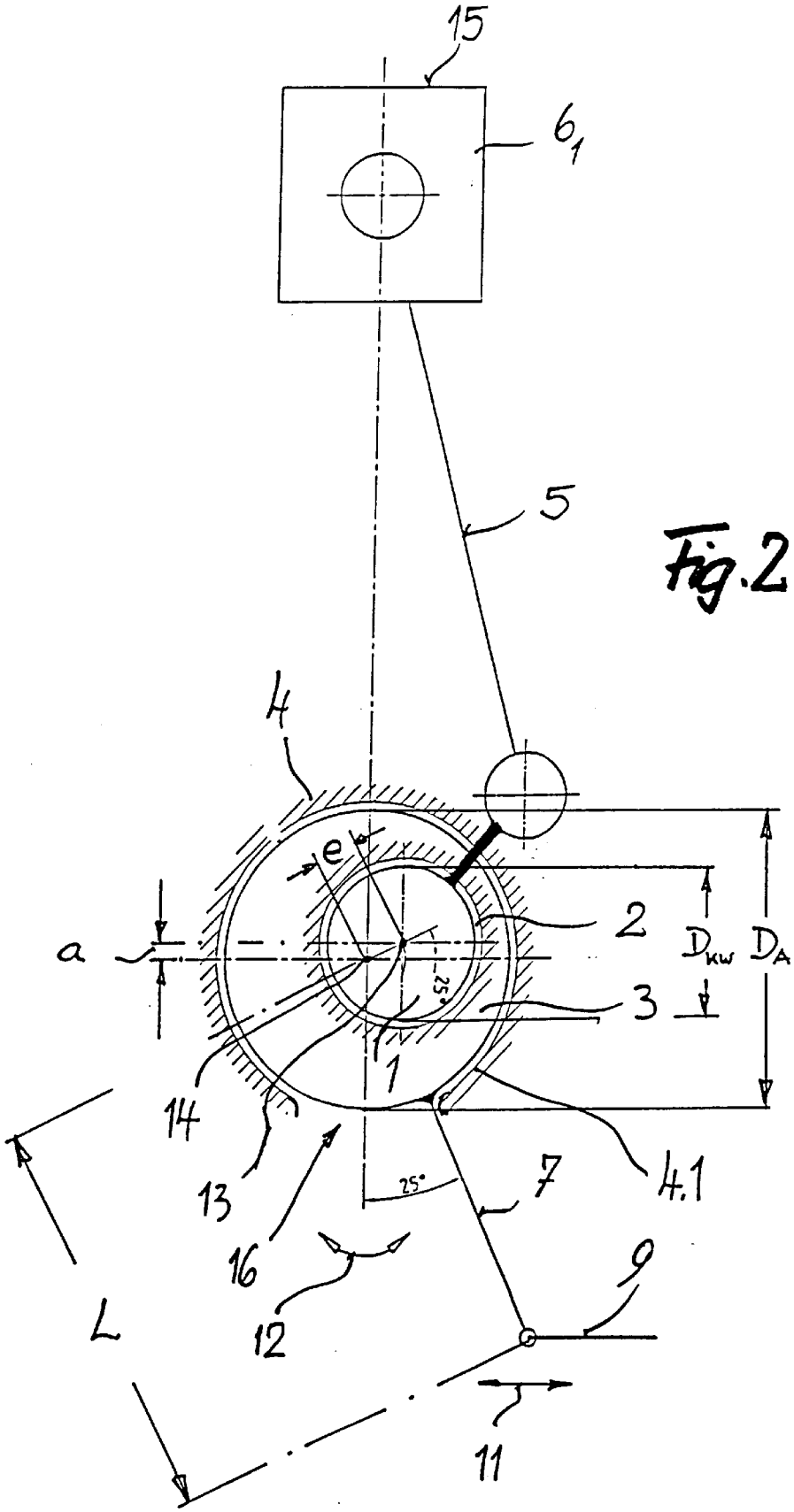
FIG. 2 is a schematic enlarged sectional view taken along line II—II of FIG. 1.

FIG. 2 illustrates the operation of the ring-turning assembly A in more detail, with reference to a single eccentric ring 3. The rotary axis 13 of the crankshaft 1 is eccentric with respect to the rotary axis (ring axis) 14 of the eccentric ring 3 and is, by means of the pivot lever 7, rotated into the shown position from an assumed mid position (in which the pivot lever 7 is oriented vertically downwardly). In this manner, the crankshaft axis 13 is lifted by a distance a relative to the stationary ring axis 14 of the eccentric ring 3. As a result of the shift of the crankshaft axis 13, upon rotation of the crankshaft 1 the piston crown 15 of the piston 6, in the upper dead center position is, by the distance a, closer to the cylinder roof, whereby the compression ratio is accordingly increased. If by means of the pivot lever 7 the eccentric ring 3 is turned in the opposite direction, the crankshaft axis 13 is lowered by a corresponding distance with respect to the stationary ring axis 14, whereby in the upper dead center position the distance of the piston crown 15 from the cylinder roof is increased and accordingly, the compression ratio is reduced.

Figure 3:
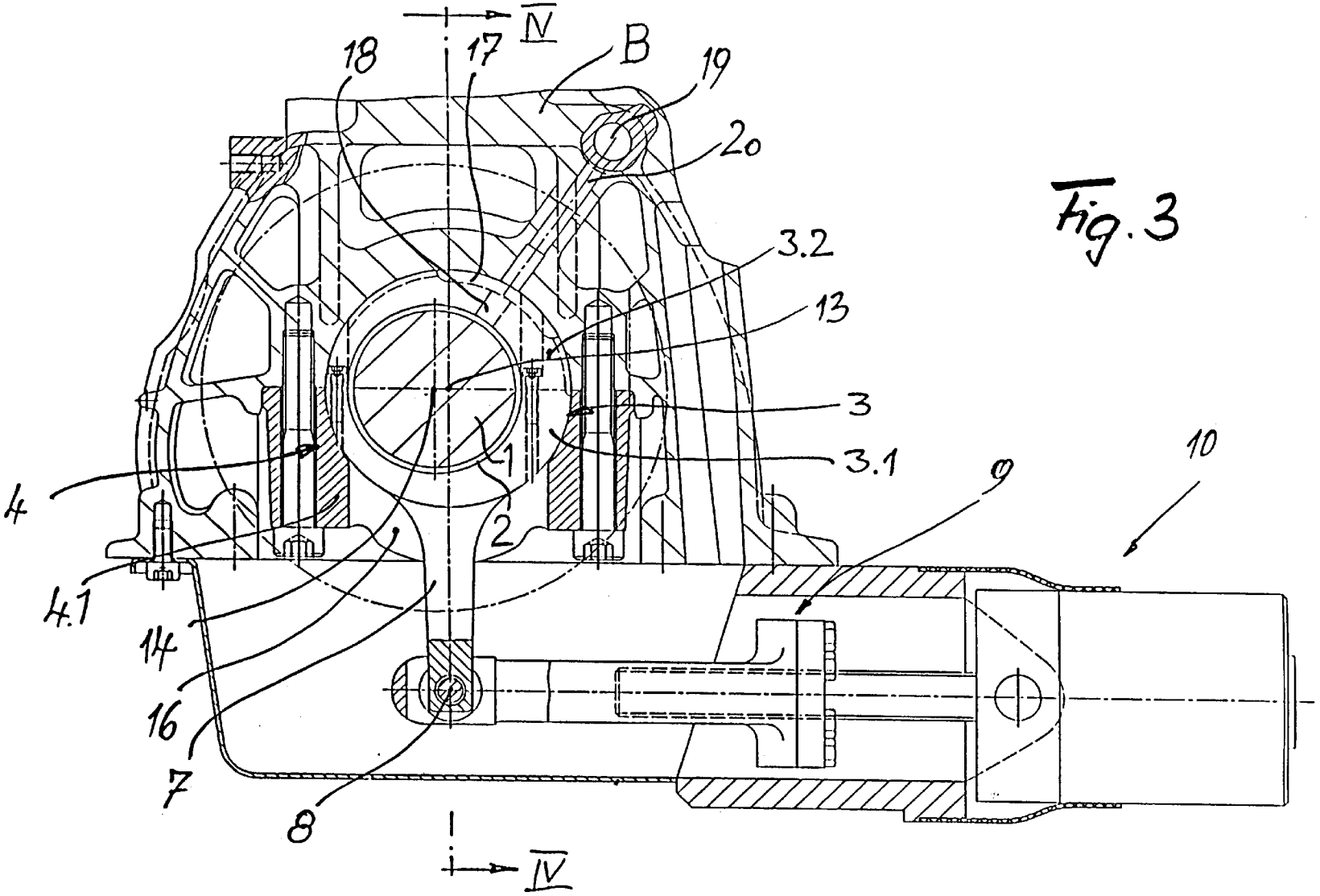
FIG. 3 is a sectional end elevational view of a structural embodiment of the arrangement shown in FIG. 2.

As it may be observed from FIG. 2, the ring-supporting bearing housing 4 has a lid 4.1 provided with a window 16 through which the pivot lever 7 projects. As seen in FIGS. 1, 2 and 3, it is expedient to so orient the pivot levers 7 that in each instance they project downwardly into the crank case.

Advantageously, the ring-turning assembly A is so designed that the ratio of the diameter $D_{KW}$ of the crankshaft bearing 2 to the diameter $D_A$ of the ring-supporting bearing housing 4 equals $D_{KW}/D_A$=0.5 to 0.75. Further, expediently, the ratio of the length L of the pivot lever 7 to the diameter $D_A$ has a magnitude of $L/D_A$=1.2 to 1.8. The ratio of the eccentricity e between the crankshaft axis 13 and the ring axis 14 to the diameter $D_A$ has a magnitude of $e/D_A$=0.04 to 0.08. The ratio of the eccentricity e to the length L is expediently e/L=0.03 to 0.07.

FIG. 3 is a sectional view of the lower region of an cylinder block B, showing details of the support for the crankshaft 1, the crankshaft bearing 2, the eccentric ring 3 and the ring-supporting bearing housing 4.

The ring-supporting bearing housing 4 for the eccentric ring 3 is formed by a divided bearing block, whose upper part is constituted by a shell in the cylinder block, while its lower part is constituted by a bearing lid 4.1. Departing from the conventional bearing lids, the bearing lid 4.1 has a slot-shaped window 16 through which the pivot lever 7 projects downwardly into an oil pan. Since the width of the support arrangement is determined by the required width of the crankshaft bearing, the width of the bearing surface of the bearing lid 4.1, reduced by the width of the window 16 is sufficient for taking up the forces generated, so that the structural length of the engine is not enlarged when using the ring-turning assembly A according to the embodiment of FIGS. 1, 2 and 3.

Each eccentric ring 3 is divided into a lower ring part 3.1 and an upper ring part 3.2. The two rings parts are attached to one another by screws and serve for holding the respective crankshaft bearings 2. The upper eccentric ring part 3.2 has a circumferentially extending groove 17 provided with a radially inwardly extending bore 18. In the cylinder block B a central oil channel 19 is provided from which branch channels 20 extend in the region of the ring-supporting bearing housings 4. The branch channels 20 open in the region of the groove 17 of the respective eccentric rings 3. By virtue of such an arrangement the lubricant supply for the bearing faces of the ring-supporting bearing housings 4 as well as for the respective crankshaft bearings 2 is ensured.

The push-pull component 9, together with the associated setting device 10 is arranged laterally on the cylinder block and extends from the oil pan.

Figure 4:
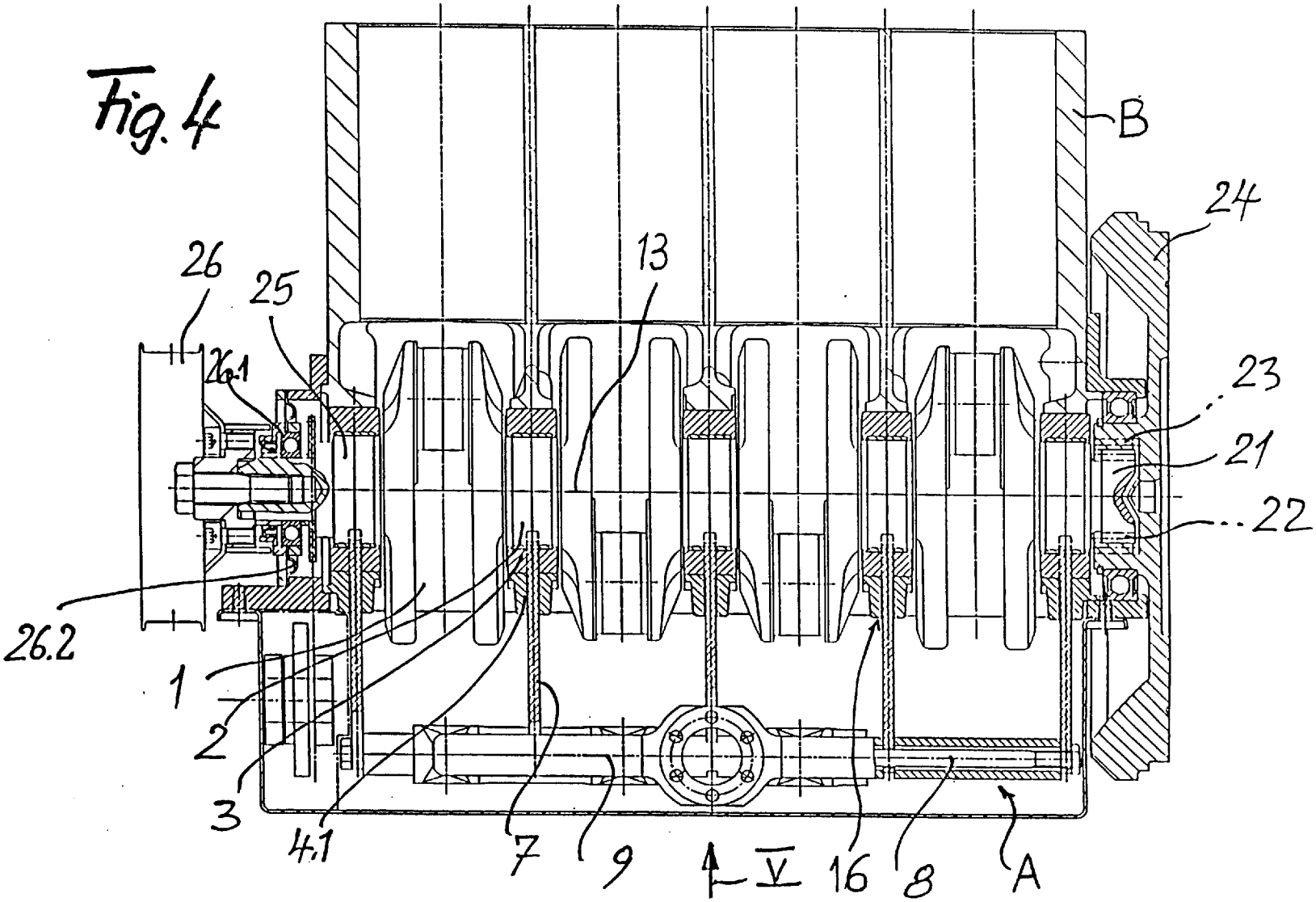
FIG. 4 is a sectional view taken along line IV—IV of FIG. 3.

FIG. 4 shows the entire bearing and support arrangement for the crankshaft 1 and the ring-turning assembly A. It is seen that the windows 16 provided in the bearing lids 4.1 and the thickness of the pivot levers 7 measured parallel to the crankshaft axis 13 are coordinated to one another such that an axial guidance of the eccentric rings 3 is effected.

At the output (driving) end of the engine, the crankshaft 1 has a stub 21 which is concentric to the crankshaft axis 13 and which is provided with a toothing 22 on its exterior. An inner toothing 23 of a flywheel 24 which is concentric with the ring axis 14 is in a meshing relationship with the toothing 22. The rotation of the crankshaft 1 is transmitted to the driven (output) components by the toothings 22, 23. When the eccentric rings 3 are turned about the ring axis 14, the toothing 22 rolls on the inner toothing 23; thus, a force transmission in any angular position of the eccentric rings 3 is ensured.

It is, however, also feasible to support the flywheel 24 on a separate axle which is fixedly secured to the cylinder block and which is oriented parallel to the crankshaft axis 13. The force transmission between the crankshaft 1 and the flywheel 24 may then be effected by means of a roller chain which, to compensate for the different lengths resulting from the radial shifts of the crankshaft, is tensioned by a chain adjuster which may be, for example, hydraulically operated.

The control-side free end 25 of the crankshaft 1 is, in the FIG. 4 construction, fixedly connected with a toothed-belt pulley 26 by means of which the usual accessories such as generator, fan, water pump, etc. are driven. Since the pulley 26 is concentric with the crankshaft axis 13 and is fixedly connected with the crankshaft 1, suitable tensioning elements have to be provided for the toothed belt to compensate for the inherent length changes resulting from the turning of the eccentric rings 3 and to maintain the toothed belt at all times at a constant tension for driving the accessories. In the embodiment according to FIG. 4 for the pulley 26 a separate bearing 26.1 is provided which is held in the cylinder block by means of a flexible sealing disk 26.2 sealing the through passage in the end face of the cylinder block. At the same time, the radial shifting motions of the crankshaft 1 with respect to the cylinder block 2 upon adjustment of the compression ratio are not affected.

It is also feasible to provide the crankshaft 1 at its control-side free end, similarly to the flywheel 24, with a stub having an external toothing which meshes with an inner toothing of the pulley 26 if the latter is rotatably supported on the cylinder block concentrically with the ring axis 14. It is likewise feasible to support the pulley 26 separately and to drive it by a chain provided with a chain adjuster as it was described earlier in connection with the flywheel 24.

Figure 5:
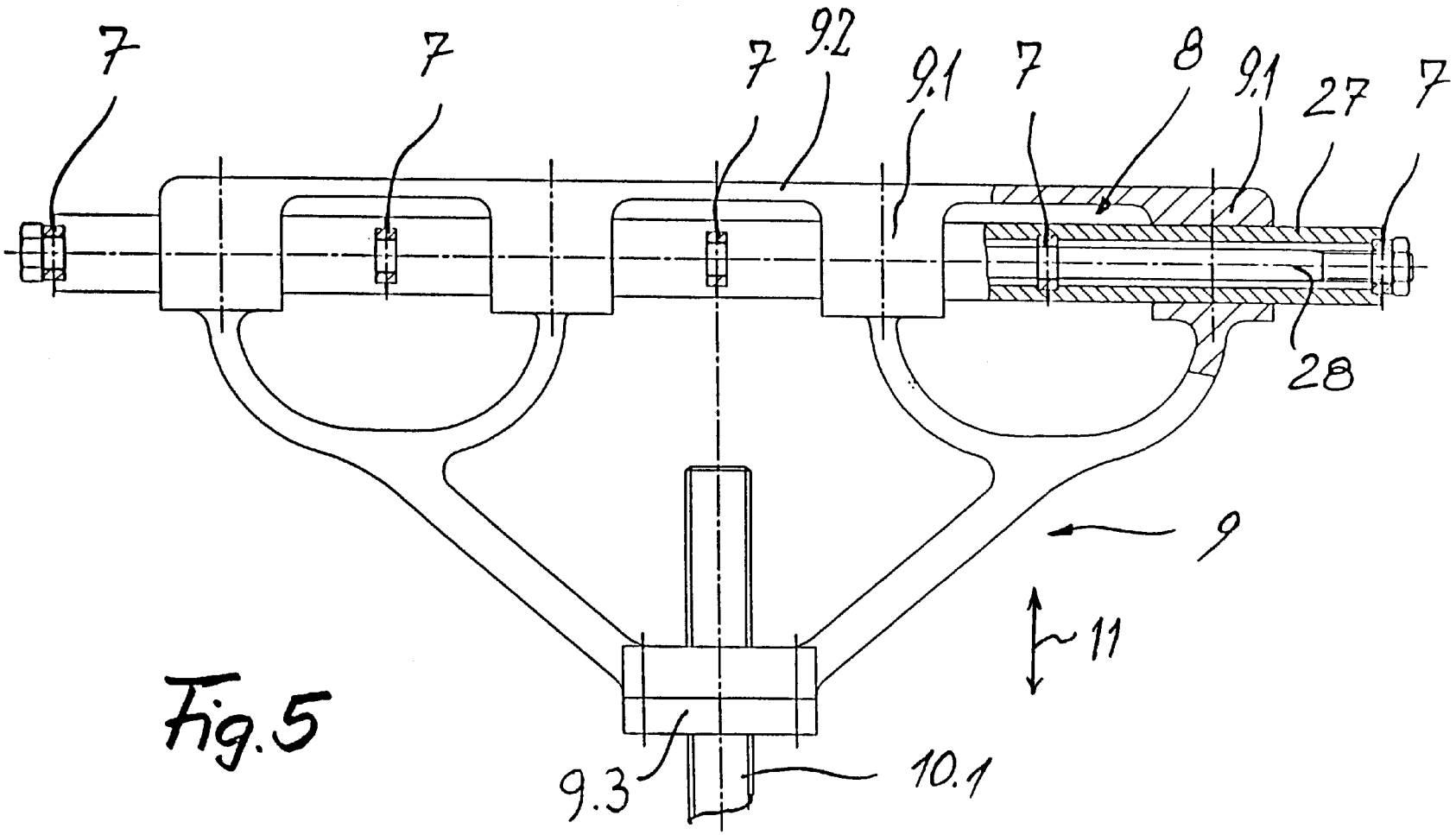
FIG. 5 is a view taken in the direction of arrow V of FIG. 4.

FIG. 5 shows in plan view the construction of the coupling element (coupling rod assembly) 8 and the push-pull component 9 connected therewith. The illustrated free ends of the pivot levers 7 are secured between the clamping sleeves 27 which are firmly tightened to one another by means of a throughgoing tensioning screw 28 and thus constitute the coupling rod assembly 8 which passes through support blocks 9.1 of the fork-shaped push-pull component 9. The support blocks 9.1 are connected with one another by means of a transverse web 9.2 which forms a unitary, one-piece structure with the support blocks 9.1, resulting in a very rigid construction of the push-pull component 9. Consequently, in conjunction with the support and design of the coupling rod assembly 8, accurately uniform adjustments of all pivot levers 7 are ensured. Further, the push-pull component 9 has a traveling nut 9.3 threadedly engaging a rotary spindle 10.1 of the setting device 10, so that upon rotation of the spindle 10.1 the push-pull component 9 is linearly displaceable parallel to the arrow 11.

Figure 7:
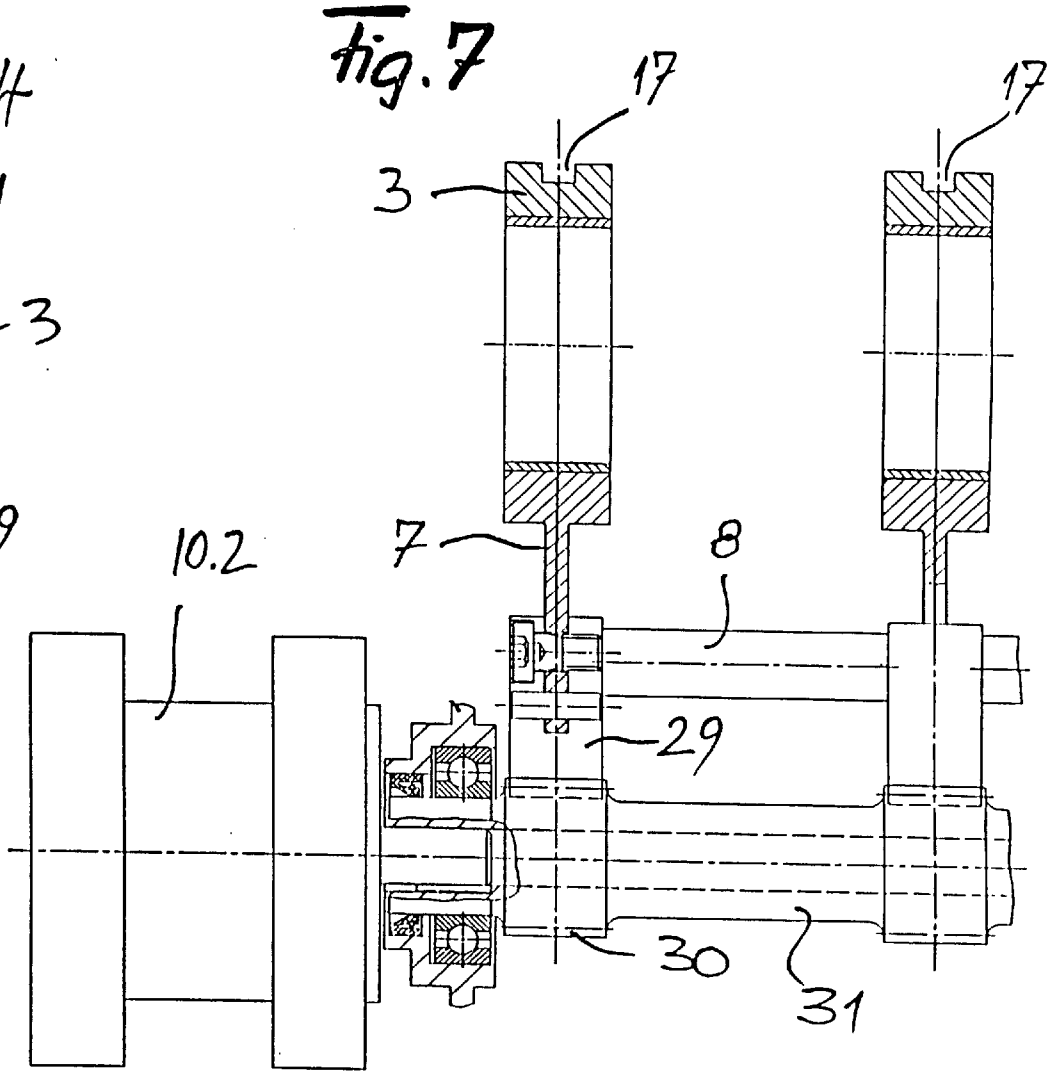
FIG. 7 is a sectional side elevation of the construction shown in FIG. 6.
Figure 6:
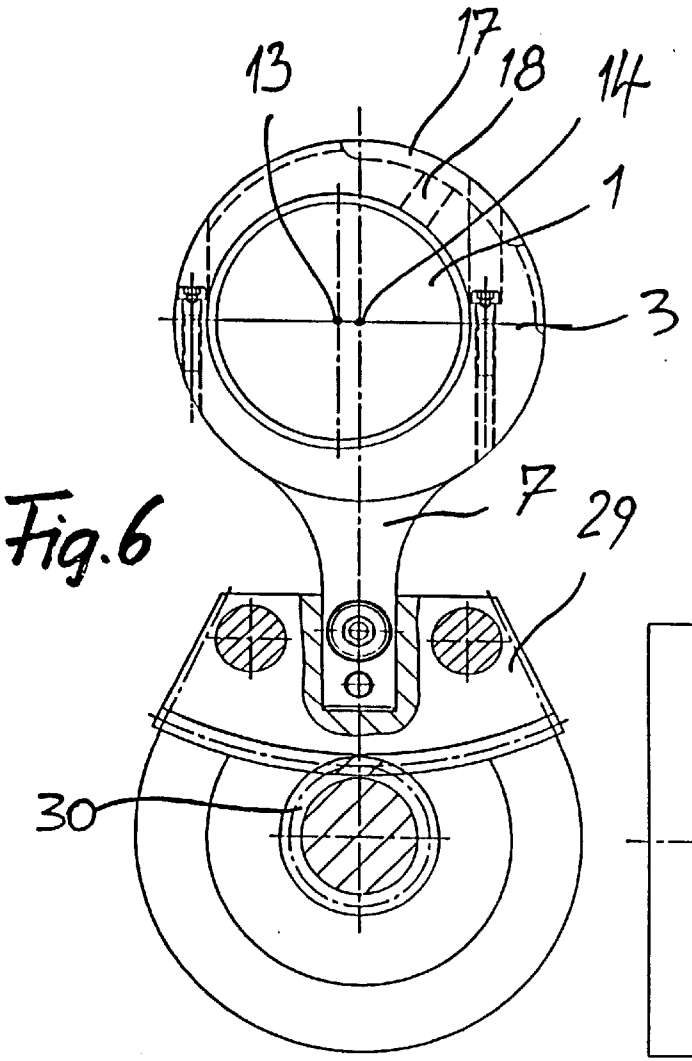
FIG. 6 is an end elevational view of a ring-turning assembly according to another preferred embodiment of the invention.

FIGS. 6 and 7 show another preferred embodiment of a device for rotating the eccentric rings 3. In this embodiment too, each eccentric ring 3 is connected with a separate pivot lever 7 which may be connected to one another by means of a coupling rod 8. At least one of the pivot levers 7 carries a circular segment-shaped toothing element 29 which is rigidly affixed to the pivot lever 7 and whose center coincides with the ring axis 14. A pinion 30 keyed to the setting shaft 31 of the setting drive 10.2 meshes with the toothing element 29.

In the embodiment according to FIG. 3 as well in the embodiment according to FIGS. 6 and 7, the setting drive is self-locking so that during operation the pistons 6 which momentarily execute expansion or compression strokes, take up, by virtue of the eccentricity between the crankshaft axis 13 and the pivot axis 14, the torques applied to the eccentric rings 3, and the compression ratio set by the setting drive 10 is reliably maintained.

Figure 8:
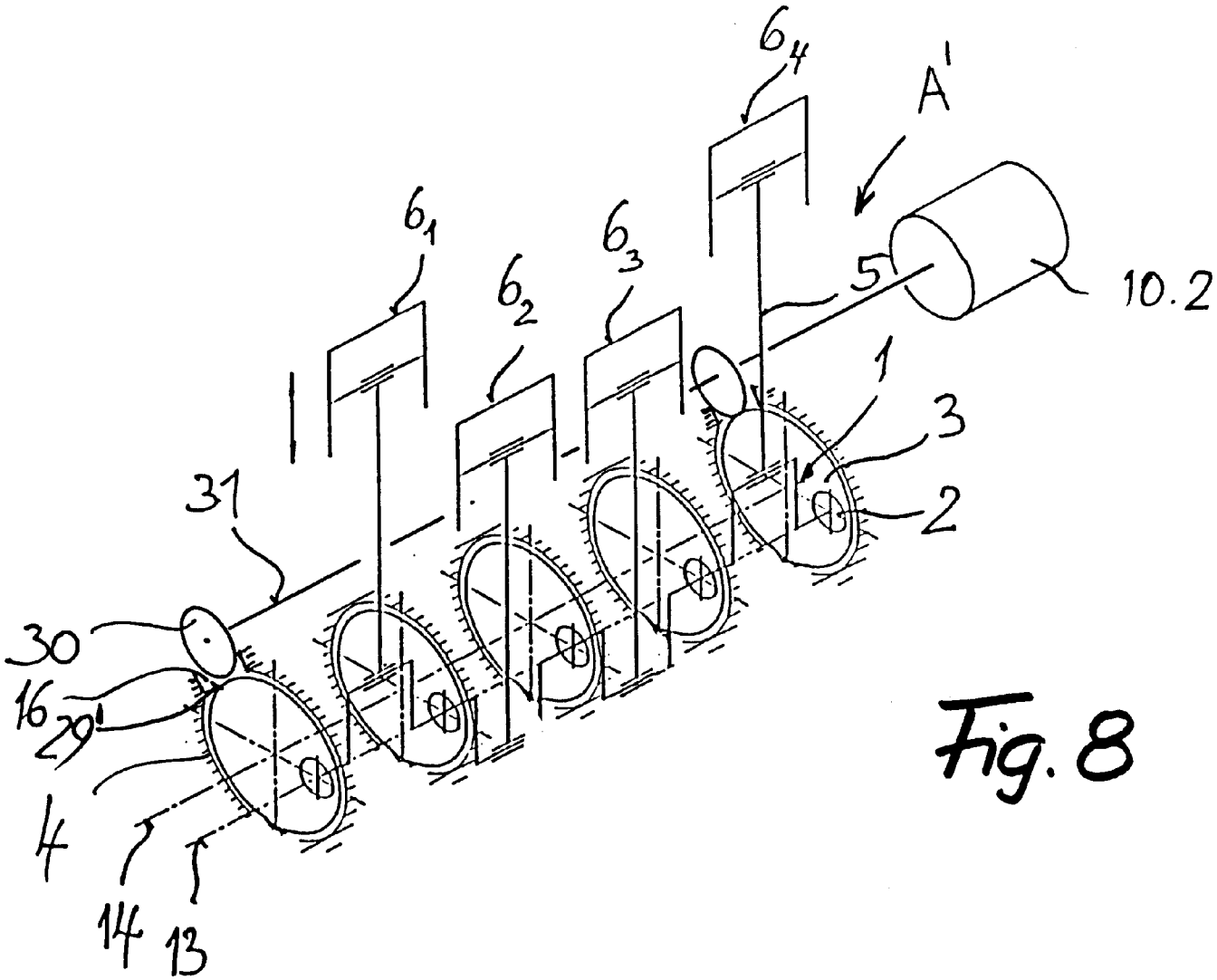
FIG. 8 is a schematic perspective view, similar to FIG. 1, of a further preferred embodiment of the invention.

FIG. 8 illustrates another preferred embodiment in which the ring-turning assembly A' includes a toothing element 29' which is affixed to the circumferential surface of an eccentric ring 3 and which meshes with a pinion 30. The pinion 30, in turn, is carried by the setting shaft 31 coupled to the setting drive 10.2. As illustrated schematically in FIG. 8 and shown in more detail in FIG. 9, the respective ring-supporting bearing housing 4 is provided with a window 16 in a region which is laterally and above the rotary axis 14 of the eccentric rings 3, so that the pinion 30, by projecting through the window 16, meshes with the toothing element 29' of the eccentric ring 3. In other details the construction and mode of operation of the embodiment of FIG. 8 is identical to that shown in FIG. 1 and described in connection therewith.

Figure 9:
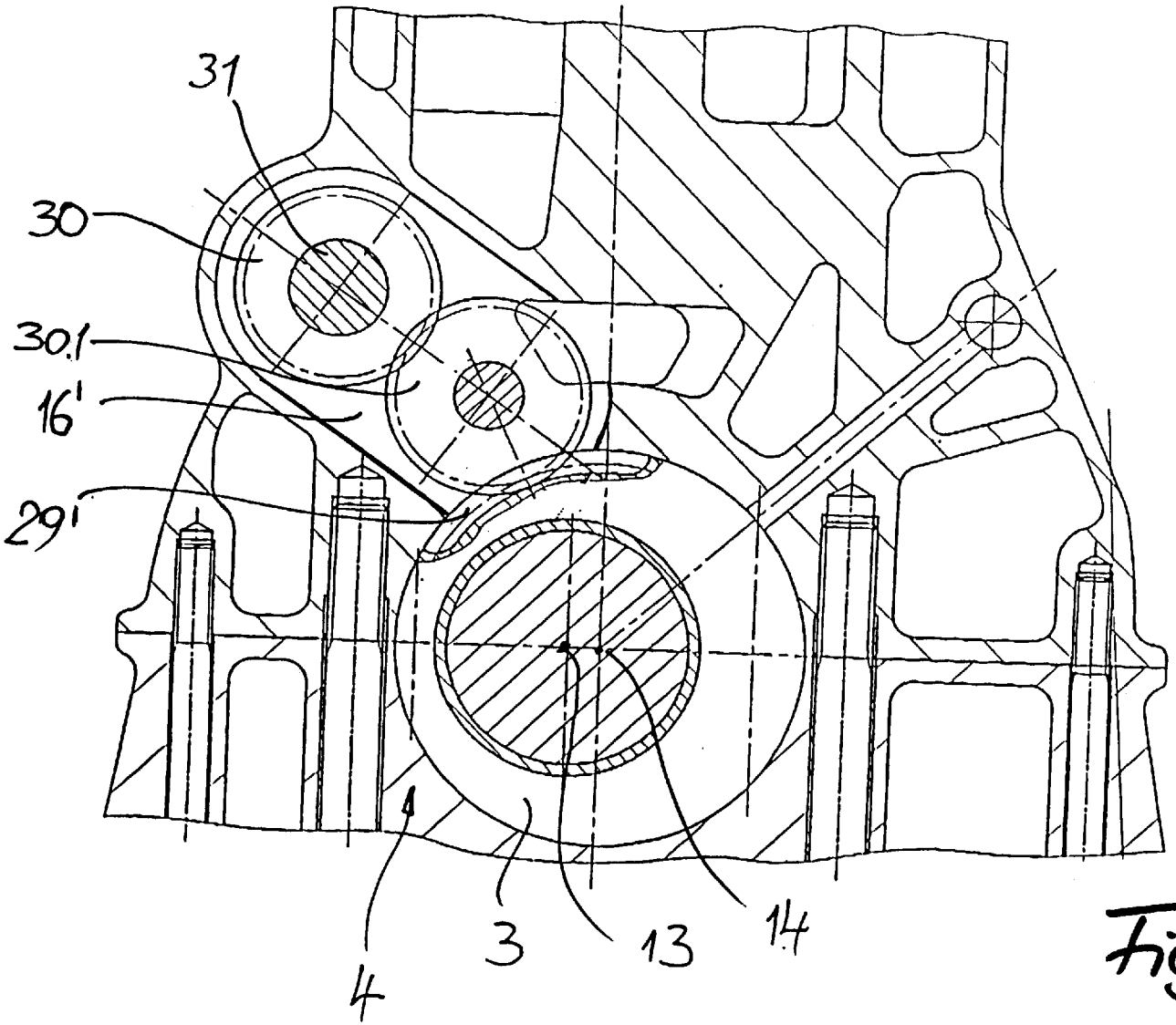
FIG. 9 is a sectional end elevational view of a structural embodiment based on the principle illustrated in FIG. 8.

To be able to observe the actual dimensional relationships in an cylinder block, the schematically shown construction of FIG. 8 has to be modified to some extent. Thus, the required free space for the circular travel path of the cranks of the crankshaft must be ensured. For this purpose the setting shaft 31 must extend at a suitable distance from the rotary axis 13 of the crankshaft 1 as illustrated in FIG. 9. The basic structure for the support of the crankshaft 1 corresponds to that described in connection with FIG. 3. While, however, the ring-turning assembly of FIG. 3 uses simple pivot levers 7 and the FIGS. 6 and 7 modifications use pivot levers 7 with a toothing element 29, in the FIG. 9 embodiment it is the eccentric ring 3 which is provided with a toothing element 29' immediately on its outer circumference in its upper region as indicated in FIG. 8. Here too, the ring-supporting bearing housing 4 is formed by a part of the fire wall of the cylinder block and is, laterally and above the crankshaft axis 13, provided with a window 16' into which the toothing element 29' projects. Within the confines of the window 16' an intermediate pinion 30.1 is freely rotatably supported which meshes with the toothing element 29' carried by the eccentric ring 3 and with the pinion 30 carried by the setting shaft 31. By providing the intermediate pinion 30.1 the setting shaft 31 extending in the longitudinal direction of the engine may be relocated outwardly to such an extent that the cranks of the crankshaft 1, together with the connecting rods coupled therewith and with the respective engine pistons, may operate unobstructed in the required free space.

Figure 10:
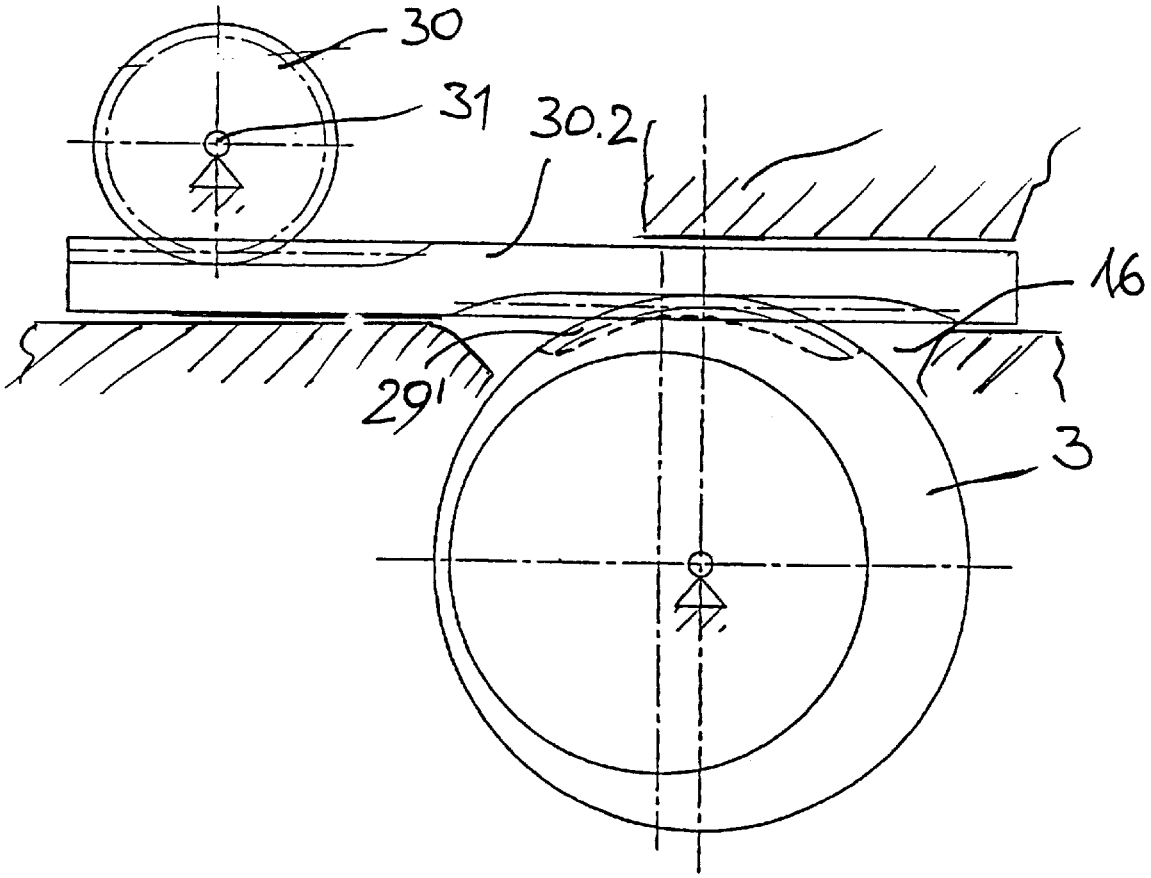
FIG. 10 is a schematic end elevational view of a variant of FIG. 8.

FIG. 10 schematically shows a variant of the embodiment illustrated in FIG. 9. In the FIG. 10 embodiment, instead of the intermediate pinion 30.1 a toothed rack 30.2 is used which is guided in the cylinder block. The toothed rack 30.2 meshes with the toothing element 29' of the eccentric ring 3 and with the pinion 30 of the setting shaft 31. By virtue of such an arrangement the setting shaft 31 may be supported, together with its pinion 30, on the exterior of the cylinder block, without significant alterations of the structural volume.

As a variant of the embodiments of FIGS. 9 and 10, in a cylinder block having windows 16 as in FIGS. 9 and 10, pivot levers 7 with toothing element 29 in accordance with the embodiment of FIGS. 6 and 7 may be used.

In the above-described embodiments each eccentric ring 3 is provided with a respective ring-turning arrangement. Dependent upon the number of the cylinders or the size of the engine, it might be expedient to directly engage by the ring-turning assembly only some eccentric rings 3, for example, those two eccentric rings 3 which are at the opposite ends of the crankshaft 1. Upon actuation of the setting device 10, those eccentric rings 3 too, which are not in direct engagement with the ring-turning assembly will rotate as well.

Figure 11:
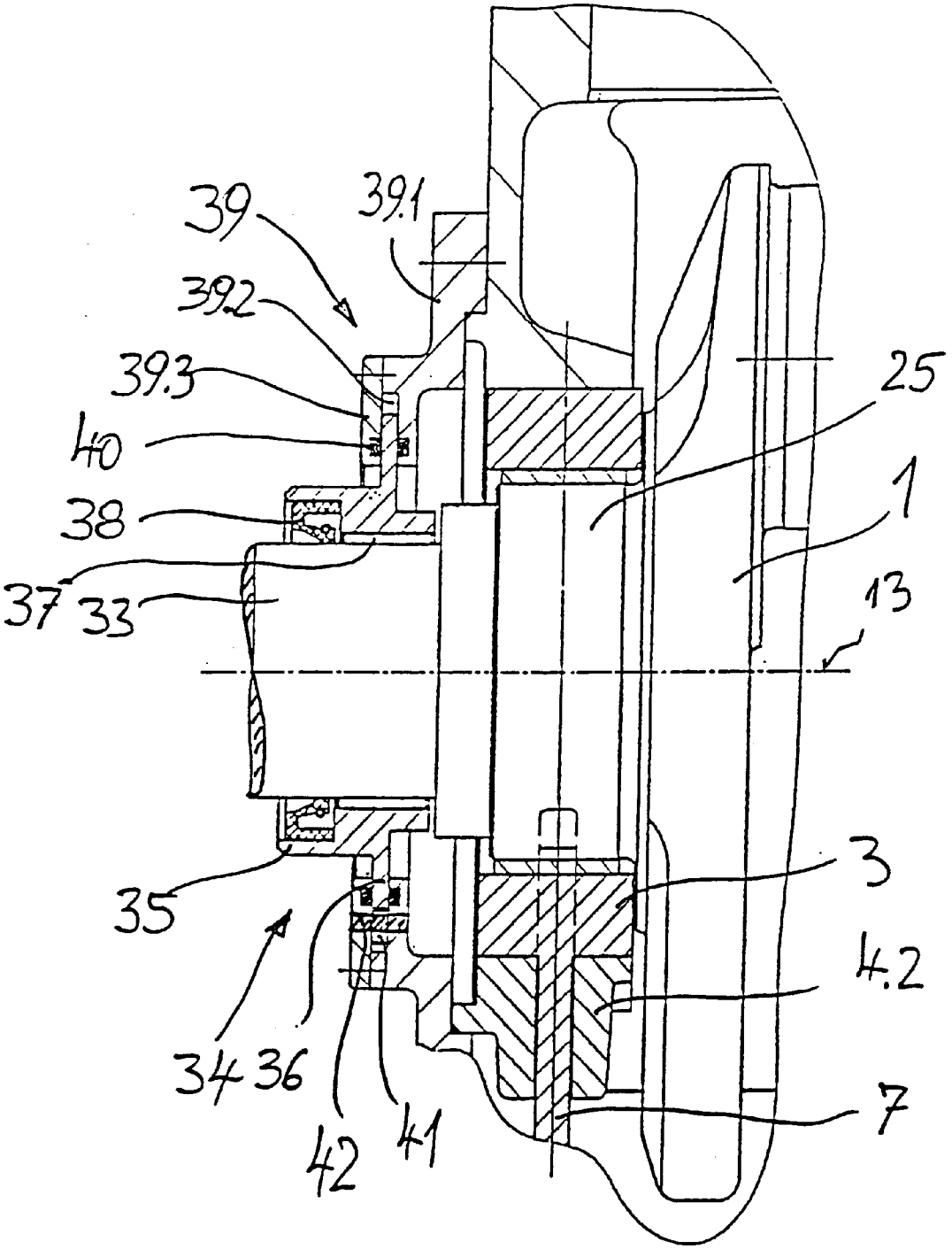
FIG. 11 is a sectional side elevational view of a sealed through-passage for the crankshaft.

While in FIG. 4 the control-side crankshaft end 25 passing through the cylinder block, is sealed by a flexible sealing disk 26.2 which yields to the necessary transverse shift of the crankshaft 1 when the compression ratio is changed, FIG. 11 shows another embodiment of the control-side seal.

As seen in FIG. 11, the crankshaft 1 is, at its control-side free terminus 25 projecting from the cylinder block, provided with a shaft stub 33 which is coaxial with the crankshaft axis 13 and which, in a manner similar to FIG. 4, is coupled with a non-illustrated belt pulley 26.

For sealing the passage of the crankshaft 1 through the cylinder block, on the stub shaft 33 a sealing disk 34 is mounted for rotation relative to the stub shaft 33. The sealing disk 34 has a hub 35 and a radially outwardly oriented disk part 36 extending from the hub 35. The hub 35 is supported on the stub shaft 33 by a bearing (such as a needle bearing) 37 and is further provided with a sealing element 38, for example, a shaft seal ring which seals the inner space of the cylinder block in cooperation with the stub shaft 33.

The sealing disk 34 is held in a sealing housing 39 at the two faces of the disk part 36 for movement relative to the sealing housing 39. The latter is fixedly attached to the cylinder block and is formed essentially of a bearing lid 39.1 provided with an aperture 39.2 in which the disk part 36 is held and covered by a closure 39.3. The bearing lid 39.1 and the closure 39.3 are, at their faces oriented towards the disk part 36, provided each with a circumferentially extending seal 40 pressed against the surfaces of the disk part 36.

If, as described earlier, for example, in conjunction with FIG. 2, by pivoting the pivot levers 7 the crankshaft 1 is displaced transversely to its rotary axis 13 in the cylinder block, the disk part 36 is shifted likewise within the sealing housing 39 while preserving the desired sealing function. The clamping forces exerted by the seals 40 on the disk part 36 are normally sufficient to maintain the sealing disk 34 in a frictional engagement in the sealing housing 39 so that the latter is moved not by the rotation of the crankshaft 1 but only as a result of a transverse motion of the crankshaft 1 relative to the sealing housing 39, effected by the pivot levers 7.

To avoid a stress on the seals 40 by a torque generated by the friction between the bearing 37 and the sealing element 38 and applied to the sealing disk 34, the disk part 36 is expediently provided at its circumference with a slot 41 through which an arresting pin 42 projects which is held in the closure 39.3 and/or in the bearing lid 39.1. The arresting pin 42 secures the sealing disk 34 against being entrained into rotation as a result of a friction between bearing and seal.

The above-described sealing arrangement may find application not only in the described environment but generally for any environment in which a rotary shaft is transversely moveable in a machine housing.

Figure 12:
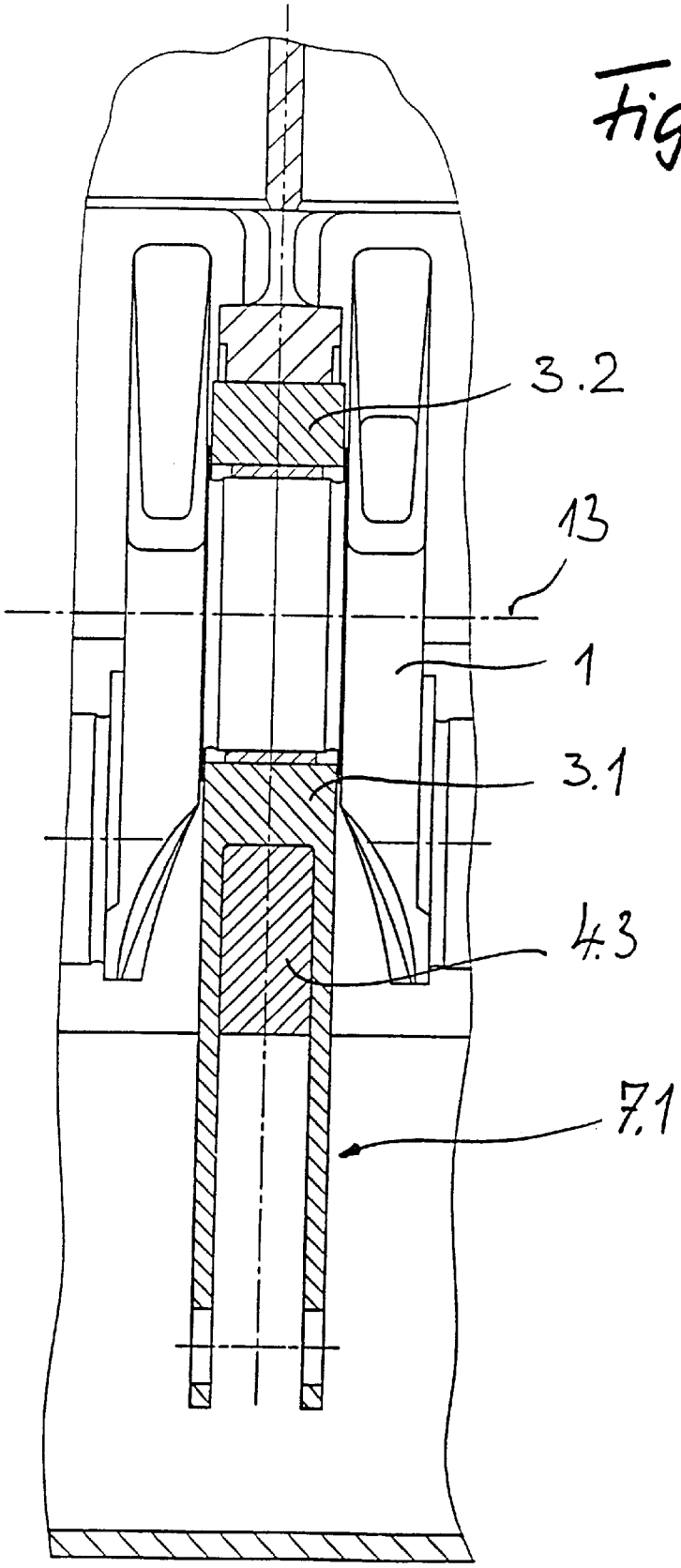
FIG. 12 is a fragmentary sectional side elevation of a crankshaft bearing and a forked pivot lever according to the invention.

FIG. 12 shows an embodiment in which the bearing lid 4.3 is of closed design. The pivot lever 7.1 connected with the associated eccentric ring portion 3.1 is of forked configuration for straddling the closed bearing lid 4.3 at both lateral surfaces thereof and, at the same time, for supporting the eccentric ring 3 in the axial direction. By virtue of the closed bearing lid 4.3 an axially throughgoing carrying and sliding surface is obtained which may be supplied with lubricant in a simple manner. Such a fork-like pivot lever 7.1 too, may be coupled with a toothing segment and may be actuated in accordance with the embodiment shown in FIGS. 6 and 7.

It will be understood that the above description of the present invention is susceptible to various modifications, changes and adaptations, and the same are intended to be comprehended within the meaning and range of equivalents of the appended claims.

What is claimed is:

1. An internal-combustion engine comprising (a) a cylinder block;

(b) a plurality of cylinders arranged in line in said cylinder block;

(c) a piston accommodated for reciprocating motion in respective said cylinders; each said piston having an upper dead center position;

(d) a crankshaft received in said cylinder block; said crankshaft having a crankshaft axis;

(e) a connecting rod coupling each piston to said crankshaft;

(f) a plurality of eccentric rings surrounding and supporting said crankshaft; each said eccentric ring being rotatable about a common ring axis radially spaced from said crankshaft axis;

(g) ring-supporting bearing housings accommodated in said cylinder block and supporting said eccentric rings; and (h) a ring-turning assembly for adjusting in unison an angular position of said eccentric rings to radially shift said crankshaft, whereby the upper dead center position of the pistons is altered for varying a compression ratio thereof; said ring-turning assembly including (1) a setting drive for exerting a force upon actuation thereof;

(2) a ring-turning component connected to at least some of said eccentric rings; each ring-turning component including a pivot lever having one end attached to a respective said eccentric ring; and a toothing element carried at another end of said pivot lever; and (3) a coupling element connecting said setting drive with said ring-turning components for transmitting said force to said ring-turning components for rotating said eccentric rings; said coupling element including a setting shaft operatively connected to said setting device; and a pinion keyed to said setting shaft and meshing with said toothing element carried by said pivot lever.

2. The internal-combustion engine as defined in claim 1, wherein said eccentric rings have an external circumferential region oriented towards a respective said cylinder; further comprising (i) a circumferential groove provided in said region;

(j) a channel provided in each said eccentric ring; said channel extending from said groove to an inner bearing surface of said eccentric ring;

(k) a central lubricating channel provided in said cylinder block; and (l) branch channels extending from said central lubricating channel through respective said ring-supporting bearing housings and opening into said groove of a respective said eccentric ring.

3. The internal-combustion engine as defined in claim 1, wherein at least some of said ring-supporting bearing housings are provided with a window through which part of respective said ring-turning components extend.

4. An internal-combustion engine comprising (a) a cylinder block;

(b) a plurality of cylinders arranged in line in said cylinder block;

(c) a piston accommodated for reciprocating motion in respective said cylinders; each said piston having an upper dead center position;

(d) a crankshaft received in said cylinder block; said crankshaft having a crankshaft axis;

(e) a connecting rod coupling each piston to said crankshaft;

(f) a plurality of eccentric rings surrounding and supporting said crankshaft; each said eccentric ring being rotatable about a common ring axis radially spaced from said crankshaft axis;

(g) ring-supporting bearing housings accommodated in said cylinder block and supporting said eccentric rings; and (h) a ring-turning assembly for adjusting in unison an angular position of said eccentric rings to radially shift said crankshaft, whereby the upper dead center position of the pistons is altered for varying a compression ratio thereof; said ring-turning assembly including (1) a setting drive for exerting a force upon actuation thereof;

(2) a ring-turning component connected to at least some of said eccentric rings; each said ring-turning component including a pivot lever having a length and being attached to a respective said eccentric ring;

(3) a coupling element connecting said setting drive with said ring-turning components for transmitting said force to said ring-turning components for rotating said eccentric rings; said coupling element including a coupling rod connected to said pivot levers and connecting said pivot levers to one another; and (4) a push-pull component extending transversely to said length and connecting said coupling rod with said setting device.

5. The internal-combustion engine as defined in claim 4, further comprising an oil pan attached to said cylinder block; each said pivot lever projecting into said oil pan.

6. The internal-combustion engine as defined in claim 4, wherein said push-pull component has a web extending along said coupling rod and spaced bearing blocks carried by said web and supporting said coupling block.

7. The internal-combustion engine as defined in claim 6, wherein said setting device comprises a threaded setting spindle; further wherein said push-pull component carries a traveling nut threaded on said spindle for effecting linear displacements of said push-pull component upon rotation of said spindle.

8. An internal-combustion engine comprising (a) a cylinder block;

(b) a plurality of cylinders arranged in line in said cylinder block;

(c) a piston accommodated for reciprocating motion in respective said cylinders; each said piston having an upper dead center position;

(d) a crankshaft received in said cylinder block; said crankshaft having a crankshaft axis;

(e) a connecting rod coupling each piston to said crankshaft;

(f) a plurality of eccentric rings surrounding and supporting said crankshaft; each said eccentric ring being rotatable about a common ring axis radially spaced from said crankshaft axis;

(g) ring-supporting bearing housings accommodated in said cylinder block and supporting said eccentric rings; said ring-supporting bearing housings being of circumferentially closed configuration; and (h) a ring-turning assembly for adjusting in unison an angular position of said eccentric rings to radially shift said crankshaft, whereby the upper dead center position of the pistons is altered for varying a compression ratio thereof; said ring-turning assembly including (1) a setting drive for exerting a force upon actuation thereof;

(2) a ring-turning component connected to at least some of said eccentric rings; each ring-turning component including a forked pivot lever straddling a respective said ring-supporting bearing housing and being attached to a respective said eccentric ring; and (3) a coupling element connecting said setting drive with said ring-turning components for transmitting said force to said ring-turning components for rotating said eccentric rings.

9. An internal-combustion engine comprising (a) a cylinder block;

(b) a plurality of cylinders arranged in line in said cylinder block;

(c) a piston accommodated for reciprocating motion in respective said cylinders; each said piston having an upper dead center position;

(d) a crankshaft received in said cylinder block; said crankshaft having a crankshaft axis and an end projecting from said cylinder block;

(e) a connecting rod coupling each piston to said crankshaft;

(f) a plurality of eccentric rings surrounding and supporting said crankshaft; each said eccentric ring being rotatable about a common ring axis radially spaced from said crankshaft axis;

(g) ring-supporting bearing housings accommodated in said cylinder block and supporting said eccentric rings;

(h) a ring-turning assembly for adjusting in unison an angular position of said eccentric rings to radially shift said crankshaft, whereby the upper dead center position of the pistons is altered for varying a compression ratio thereof; said ring-turning assembly including (1) a setting drive for exerting a force upon actuation thereof;

(2) a ring-turning component connected to at least some of said eccentric rings; and (3) a coupling element connecting said setting drive with said ring-turning components for transmitting said force to said ring-turning components for rotating said eccentric rings;

(i) a stub attached to said end of said crankshaft and being in axial alignment with said crankshaft axis;

(j) a sealing disk mounted on said stub and being rotatable relative to said crankshaft; said sealing disk having a sealing disk part provided with opposite radial surfaces;

(k) a sealing housing affixed to said cylinder block and receiving said sealing disk part; said sealing disk part being radially displaceable relative to said sealing housing; and (l) a sealing element held in said sealing housing and sealingly engaging said stub.

* * * * *